United States Patent [19]

Shearer et al.

[11] Patent Number: 4,785,293

[45] Date of Patent: Nov. 15, 1988

[54] ALARM SYSTEM PRIOR TO FIREDOOR DROP

[76] Inventors: Leonard Shearer, 1302 Farlington, W. Covina, Calif. 91790; William Paulsen, 4754 Alamo St., Simi Valley, Calif. 93063; Roger Moody, 10449 Dempsey Ave., Grenada Hills, Calif. 91344

[21] Appl. No.: 805,967

[22] Filed: Dec. 5, 1985

[51] Int. Cl.[4] ..... G08B 17/10

[52] U.S. Cl. ..... 340/628; 49/31; 160/9; 160/10

[58] Field of Search ..... 340/628, 629, 630, 654, 340/663, 825.32, 825.37, 545; 49/13, 31; 187/51, 52 R, 1 R; 160/1, 6, 7, 9, 10

[56] References Cited

U.S. PATENT DOCUMENTS

| | | | |
|---|---|---|---|
| 437,708 | 10/1890 | Montgomery | 49/13 X |
| 554,517 | 2/1896 | Jackson | 49/13 X |
| 1,698,410 | 1/1929 | McFarland et al. | 49/13 X |
| 2,103,324 | 12/1937 | Down | 49/13 X |
| 2,137,196 | 5/1937 | Sampson | 246/130 |
| 2,598,196 | 5/1952 | Staley | 246/130 |
| 3,777,423 | 12/1973 | Coulter et al. | 340/629 X |
| 4,040,143 | 8/1977 | Lasier et al. | 49/31 X |
| 4,130,156 | 12/1978 | Wardlaw | 160/9 |
| 4,237,654 | 12/1980 | Landem et al. | 49/141 |
| 4,365,250 | 12/1982 | Matsuoka et al. | 340/825.32 |

*Primary Examiner*—James L. Rowland
*Assistant Examiner*—Jeffery A. Hofsass
*Attorney, Agent, or Firm*—Frank L. Zugelter

[57] ABSTRACT

A signalling system utilized in a firedoor control system. For warning and alerting personnel of the immanate (seconds) closing of a firedoor, to avoid injury of such personnel in the vicinity of the closing firedoor. The system is actuated by being responsive to either a smoke detector signal or to an electrical failure to the smoke detector. Means responsive to the smoke detector generates a first control signal, a first timer means generates a second control signal at the end of a first delay interval, and a second timer means generates a series of reoccurring control pulses transmitted to audible and visual signalling elements. A test means is provided to determined operational (functional) status of a rechargable battery utilized in the system in the event of an electrical failure to the smoke detector.

20 Claims, 3 Drawing Sheets

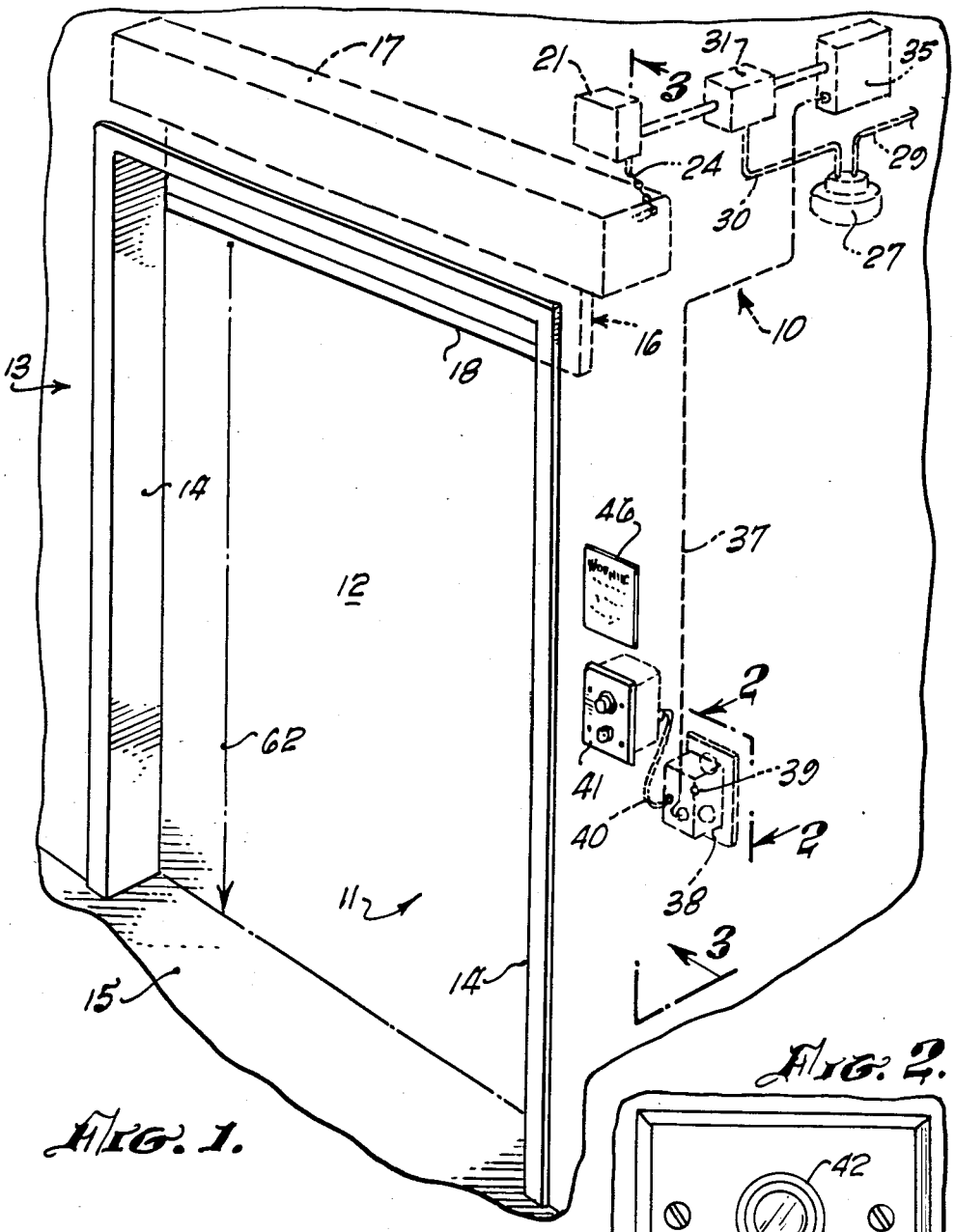
FIG. 1.
FIG. 2.
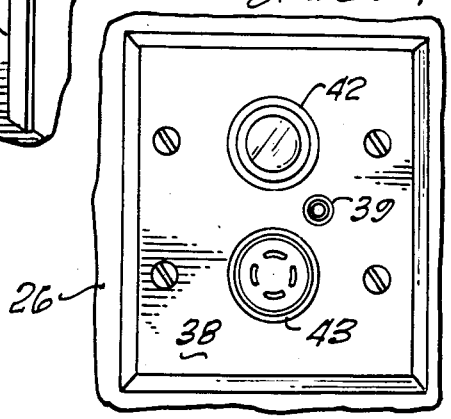

ALARM SYSTEM PRIOR TO FIREDOOR DROP

TECHNICAL FIELD

This invention is directed to a warning system for a firedoor actuated into a closed-position mode, and in particular, a system for warning persons in the physical proximity of a fire door that the latter will be closing within a short period of time, such as, for example, within 10 to 30 seconds.

PRIOR ART PRACTICE

Firedoors across doorways are closed automatically upon detection of smoke. The existing system to do this in practice in a typical installation includes a smoke detector, a time-delay release mechanism, a firedoor-and-hood assembly, and an applicable electrical circuit between smoke detector and mechanism. Very little time elapses between actuation of such existing system and the closing of the firedoor, whether the latter falls or drops in a vertical manner or is operated from the side of a doorway. Such existing system does not consider the danger always present, viz., that persons in physical proximity to the doorway will be struck by the fire door in its closing, and thereby be injured.

ADVANTAGES OF THIS INVENTION

This invention provides warning, visual and audible, to a person who is in the vicinity of a firedoor, that it will be closing in a matter of so many seconds. Such person or persons then can move swiftly away, out of danger of injury by the closing of the firedoor upon their persons.

This invention is readily adaptable to existing firedoor closing systems, without undue modification of the existing systems. It can be added to such an existing system in an efficient and expeditious manner.

The invention also is readily adaptable to other systems wherein an interruption of voltage occurs and a warning signal is desirous that such has occurred. An example of such an environment is refrigeration systems.

SUMMARY OF THE INVENTION

The system of this invention comprises an electrical control unit which is operatively connected to a smoke detector to a firedoor time-delay release mechanism, and to warning elements on first and second panel units mounted on a wall, the warning elements comprising visual and audible means presented to persons on each side of the wall in the vicinity of the doorway. One of the wall panel units including the warning elements includes test means by which the condition of operability of the invention can be periodically tested. The electrical circuitry includes means for detecting either a condition of smoke or a loss of electrical power to the smoke detector, such a condition relaying a signal through actuation of the control unit to the time-delay firedoor release mechanism that controls release means (arm) in a firedoor-and-hood assembly. Actuation of the release arm initiates closing of the firedoor across a doorway. The control unit includes its own rechargeable battery for generating power to provide the necessary signals upon smoke detection and electrical failures in the building in which the firedoor is installed. The control unit also can be utilized in any other environment, e.g., a refrigeration system, in which voltage is interrupted and a warning signal therefrom is desirous.

An object of this invention is to provide safety from physical harm to personnel working in or otherwise in physical vicinity of a firedoor that will close upon the detection of a smoke or electrical condition that actuates the firedoor's time-delay release mechanism.

Another object of the invention is to provide a warning, visual and/or audible, that a firedoor will be closing immediately, i.e., prior to its actual closing movement.

A further object of this invention is to provide the elimination of a hazard to employees or the public that presently exists at doorways at which firedoor release mechanisms are installed but without this invention applied thereto.

Another object of the invention is to provide a warning system to an existing firedoor release mechanism without interfering with or interrupting the actuation of such release mechanism.

A still further object of the invention is to provide a relatively inexpensive installation of a warning system prior to firedoor close, without any major or significant modification of existing firedoor release or time-delay release mechanisms.

A still further object of the invention is to provide a warning control system that can be utilized in any environment and wherein a voltage exists that fails, the failure of which is desired to be noted.

These and other objects and advantages of the invention will become more apparent upon a full and complete reading of the following description, taken in conjunction with the appended claims thereto and the accompanying drawing comprising three (3) sheets of five (5) FIGURES.

BRIEF DESCRIPTION OF THE DRAWING

FIG. 1 is a perspective view of an installation of the invention in a firedoor environment.

FIG. 2 is a frontal view taken on line 2—2 of FIG. 1, of a wall panel including audible and visual warning elements of and test means for the invention.

BEST MODE FOR CARRYING OUT THE INVENTION

Figure 3:
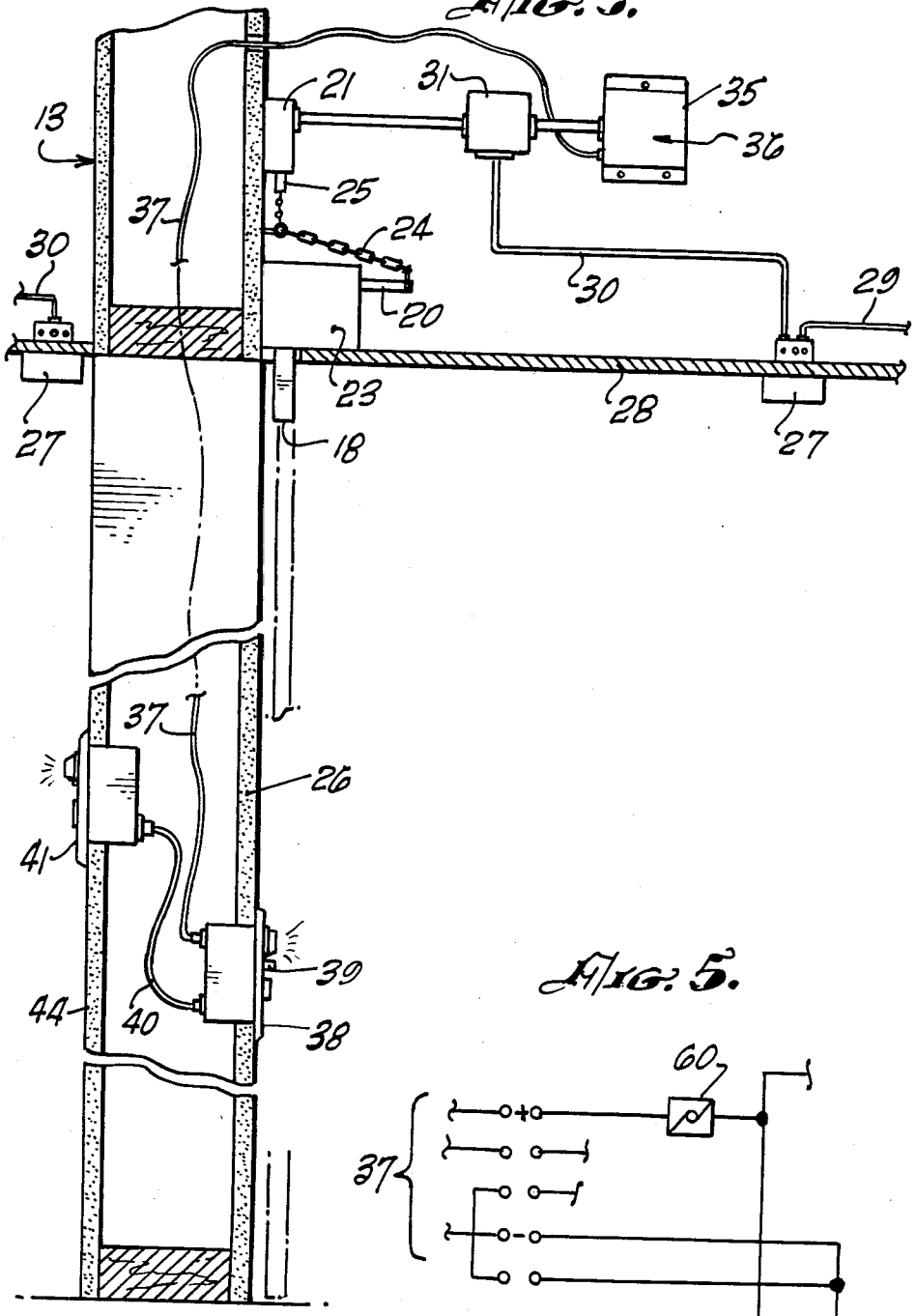
FIG. 3 is a generally cross-sectional view of an installation of the invention in relation to a wall environment including a firedoor and its release mechanism, taken on line 3—3 of FIG. 1.

Referring now to the drawing wherein reference characters therein correspond to like numerals hereinafter following, reference character 10, FIG. 1, refers to an assembled installation of the invention at a firedoor location 11. A typical state-of-the-art firedoor location 11 includes a doorway 12 formed in a wall 13, vertically disposed sides 14 joined by a lintel (not referenced) to form the doorway 12 mounted upon a floor 15. The construction of these building elements is in accordance with generally present acceptable practices. To the one side of wall 13 along which a firedoor 16 is disposed, a hood 17 is conveniently mounted above the doorway, in suitable and known manner, to house firedoor 16. A leading edge or foot-piece 18 of firedoor 16 is disposed in a hanging fashion in the door's non-actuated position mode.

Firedoor 16 is assembled in its hood 17 in accordance with generally known acceptable practices, and is not part of the instant invention, except to the extent that an element 20, FIG. 3, of the firedoor-and-hood assembly is operatively connected to the system of the present invention via a time-delay release mechanism 21 utilized in existing automatic firedoor assemblies.

One example of mechanism 21 is the commercial embodiment, Model 3892, made and sold by The Cookson Company, 700 Pennsylvania Avenue, San Francisco, Calif. 94107, and which is disclosed in U.S. Pat. No. 4,130,156.

Included in the firedoor-and-hood assembly, for dropping firedoor 16, there is the element or release means (arm) 20, FIG. 3, projecting out of the rear of an end panel 23 of hood 17. One end of a sash chain 24 attaches to release arm 20 while its other end attaches to a sash chain ring 25 which depends from time-delay release mechanism 21 suitably secured upon one panel 26 of wall 13. Chain ring 25 drops out of a hooking arrangement (not shown) on mechanism 21 in the event time-delay release mechanism 21 is actuated, so that release arm 20 drops, thereby causing firedoor 16 to close across doorway 12. Time-delay release mechanism 21 actuates the release arm 20, upon sensing a signal from one or more smoke detectors 27 suitably secured to a ceiling member 28 in proximate vicinity of and remoteness from doorway 12. Smoke detectors 27 are electrically connected, such as by electrical lines in conduits 29, (only one shown in FIG. 3), to a suitable source of power for the building and by which upon detection of smoke (or fire) transmits signals to time delay release mechanism 21 via electrical lines in conduit 30. Mechanism 21 then functions to release firedoor 16 from its rolled up (non-actuated) mode to swiftly close upon doorway 12, via removal of sash chain 24 from its hooking arrangement in mechanism 21 and arm 20 being actuated by such removal.

It may be noted here that the present invention does not replace mechanism 21 for releasing firedoor 12 from it non-actuated mode of position. A junction box 31 is provided wherein the electrical (hot, ground, neutral) lines e1, e2, e3, FIG. 4, from control unit 36 are connected in parallel to their corresponding lines in conduit 30, such connection made in accordance with acceptable standards of existing wiring code.

Figure 4:
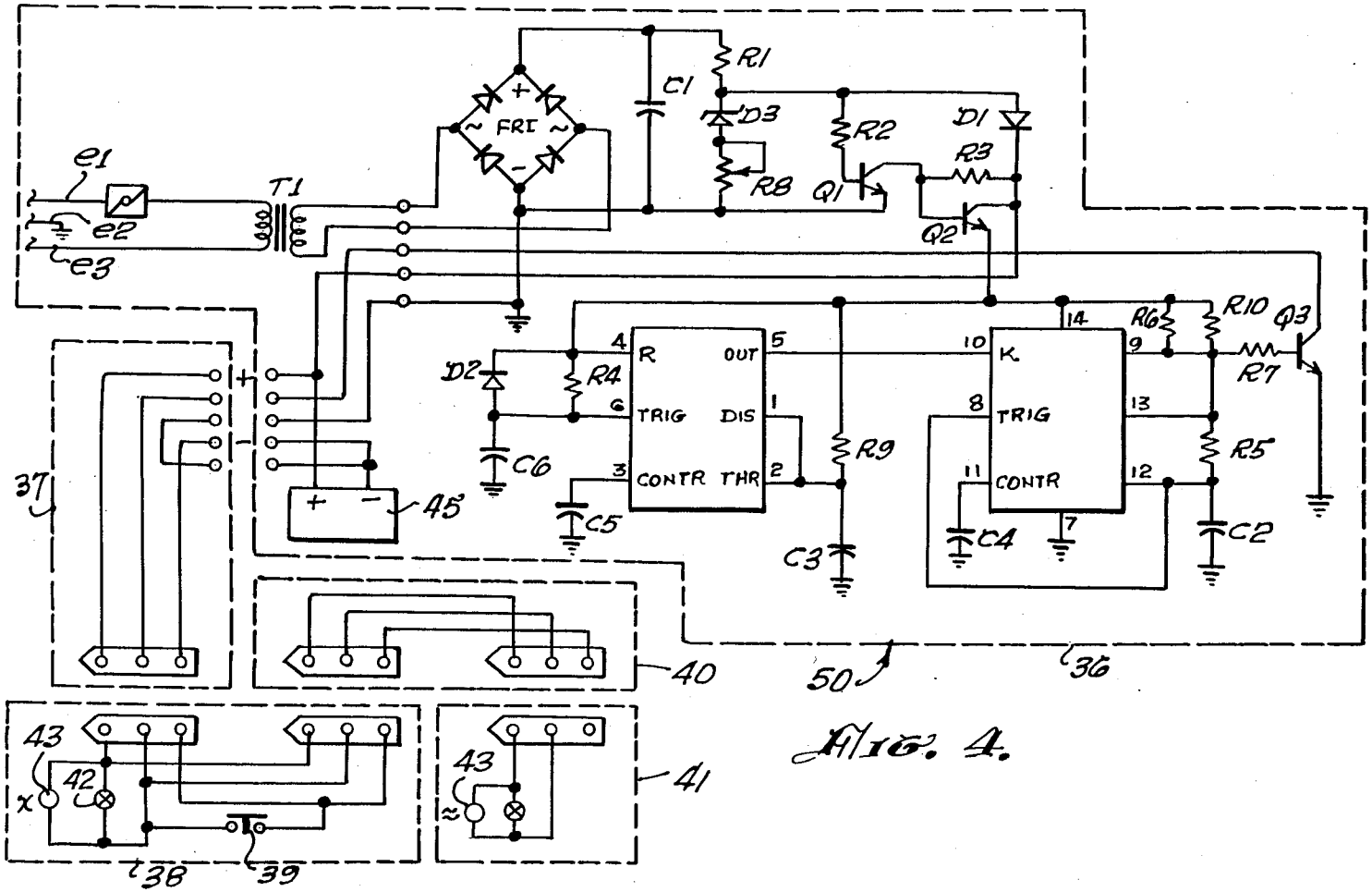
FIG. 4 is a schematic drawing of the electronic circuit that controls the actuation of the warning system of the invention.

Turning now more particularly to the subject matter of this invention disclosed in the embodiment depicted in the drawing, a control box 35, FIG. 3, houses the invention's control unit 36, FIG. 4, by which audible and visual warnings are established upon its actuation. Control unit 36 is connected via low voltage electrical lines 37 to warning elements in a first wall panel unit 38. Unit 38 includes a means for testing, such as a button 39, operability of the system of the invention periodically. From test unit 38, electrical lines 40 extend (in electrical parallel) to warning elements in a second wall panel unit 41. The warning elements, light signaling element 42 and audible signaling element 43, are mounted, with testing means 39, in panel unit 38 and in panel unit 41. Panel units 38, 41 are mounted on wall panels 26, 44. FIG. 3, respectively, at desired remote or proximate locations relative to the location of doorway 12. Panel unit 38 is mounted on wall panel 26 for the convenience of employee personnel who usually are working in the vicinity of doorway 12 and who can test, by button 39, the operability of the system of this invention by reason of a rechargable battery 45 which powers control unit 36 in its operational mode. Panel unit 41 is suitably secured upon the other wall panel 44 of wall 13 for visual and audible signalling to persons on that side of doorway 12. A warning label 46 [FIG. 1] is mounted in close vicinity to panel unit 41 to inform persons, usually other than employees, of the presence of the invention. Such warning label includes a notice (of warning) which informs such a person that in the event that warning signals 42, 43 function they should stand clear of doorway 12. Such instruction provides a sense of assurance, comfort, and relief, then, to these persons who know by reading such instructions that they can prevent injury to themselves by properly acting upon the actuation of warning signals 42, 43. In other words, they are not put into fear of life or limb by a pending swiftly-closing fire door 16.

Reference character 50 refers to and identifies the electrical circuitry of the control unit 36. Circuit 50 comprises an 18 V AC transformer T1, which in conjunction with a full-wave rectifier FRI, converts AC voltage to a DC voltage, which is filtered by a capacitor C1. Current is limited through a resistor R1. The DC voltage now is regulated by a Zener diode D3 and a resistor R8, R8 being used to adjust the regulated voltage. The regulated voltage is adjusted to +7.20 V DC and is coupled to battery 45 by a diode D1 to provide a means of trickle charging battery 45 when AC power is available to it.

At the anode of diode D1, electrical line power is sampled for its presence through a resistor R2. The base of transistor Q1 is connected to resistor R2 and uses it to pass only a sample current to determine if power is present. When power is present, transistor Q1 is turned on, to pass current from its collector to its emitter. Collector power for transistor Q1 is supplied through a resistor R3 and which obtains it power (current) from battery 45. The base of transistor Q2 is connected to the collector of transistor Q1. The collector of transistor Q1 is connected to the positive terminal of battery 45. When AC power (through transformer T1) is present, transistor Q1 will be turned on which causes Q2 to be turned off. This disables the first timer circuit of a dual timer integrated circuit, comprising a (14 pin) chip 556 which is shown in FIG. 4 as two (2) halves for clarity of presentation of the circuitry. The chip 556 is a well-known commercially-available chip. When AC power is not present, via transformer T1 transister Q1 will be turned off, allowing Q2 to be turned on, and "enables" the first timer circuit of chip 556. After power is applied to its first timer circuit through transister Q2, the chip's "enabling" is briefly delayed, say, approximately 0.5 seconds, through the network comprising a resistor R4, capacitor C6, and diode D2. After the first timer of the chip is enabled, it enables the second timer of the chip for, say, 30 seconds, this time period being controlled by a capacitor C3 and a resistor R9. When the second timer of chip 556 is enabled it provides one-second pulses to the base of transistor Q3, turning this transistor Q3 on and off at 1-second intervals. The timing for this is provided by the timing control circuit comprising capacitor C2, and resistors R5 and R10. Transistor Q3 is used to switch on and off any external 6-volt DC signalling device, such as the warning signalling elements 42, 43 in panel units 38, 41 and to which power is supplied by battery 45.

Capacitors C4, C5 and resistor R6 function as stabilizers and enhance the performance of chip 556. Resistor R7 limits current flow.

Figure 5:
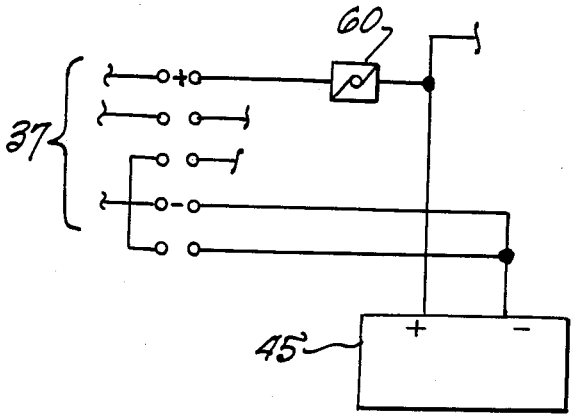
FIG. 5 is an exploded view of a portion of FIG. 4.

An in-line fuse 60, FIG. 5, may be utilized between the positive terminal of battery 45 and line(s) 37, as a safety precaution.

It now should be apparent that the first timer of chip 556 provides for automatic shut-off of control unit 36, while the timer circuitry of the second half of chip 556 provides reoccurring intervals of time during which audible and visual signals pulse at elements 42, 43.

In operation, when power flows to control unit 36, transistor Q1 is off and the first timer circuit in chip 556 is disabled. No control pulses emanate to signaling elements 42, 43. Control unit 36 is actuated upon the occurrence of either of two conditions. By smoke being detected by the sensor (relay) of one or more of smoke detectors 27, or by a power loss occurring at the smoke detector. In either case, a power (current) flow to such element, sensor or relay is interrupted. Consequently, line power to the supplementary warning device (control unit 36) is interrupted. Voltage is lost at transformer T1. Q1 turns off, allowing Q2 to be turned on since battery 45 is operational. This turning on of Q2 enables the two timing circuits of dual timer chip 556. During the timing period that ensues, signals at elements 42, 43 occur at both wall panel units 38, 41, and after a time interval of seconds, firedoor 16 closes in the direction of arrow 62, FIG. 1. At the end of the timing period, the visual and audible signals no longer emanate from elements 42, 43.

To test battery 45 of control unit 36, test button 39 is depressed, closing its switch, FIG. 4. If battery 45 is charged (operational), current flows therefrom to signalling elements 42, 43 in each wall panel 38, 41, such elements emitting their respective visual and audible warnings without pulsing, to show that the battery is functioning.

Electronic circuitry 50 is assembled on a circuitboard (not shown) by known processing or production techniques, while the circuitboard itself is printed also by known production techniques, in correlated fashion to the above described elements of circuitry 50. Assembly of all the aforesaid elements within control box 35 is achieved in known and suitable manner, as well as the wiring up in parallel of control unit 36 with the wiring for smoke detector 27 and time-delay release mechanism 21, junction box 31 providing a suitable access point at which the parallel wiring up can be carried out. And the materials of the aforesaid elements also are well known. The followng list is an exemplary listing of components that are utilized in the circuitry of control unit 36.

| Identified Component | Description of Component | Quantity Used |
|---|---|---|
| FRI | Full Wave Bridge Rectifier lamp 50 piv I.C. PK9 | 1 ea |
| C1, C2 | 1 mfd 15-25 v (up to 50 v if samll Pk9) | 2 ea |
| C3 | 330-350 mfd 15-25 v | 1 ea |
| C6 | 47 mfd 15-25 v | 1 ea |
| | DIPPED TANTALUM | |
| C4, C5 | .1 mfd 15-35 v | 2 ea |
| | FIXED RESISTORS 5-10% ¼ w/carbon | |
| R1 | 2K | 1 ea |
| R2, R3 | 4.7K | 2 ea |
| R4, R6 | 1K | 2 ea |
| R5 | 470K | 1 ea |
| R7 | 160K | 1 ea |
| R9 | 56K | 1 ea |
| R10 | 330K | 1 ea |

-continued

| Identified Component | Description of Component | Quantity Used |
|---|---|---|
| | P.C. Mt Thumb Whl Vert Pot | |
| R8 | 10K | 1 ea |
| | Diodes, I.C., Transistors | |
| Q1 | 2N3904 | 1 ea |
| Q2 | MPSA06 GE | 1 ea |
| Q3 | TIP 31 | 1 ea |
| Chip | LM556 (IC) | 1 ea |
| D1, D2 | 1N4001 | 2 ea |
| D3 | 1N4735 6.2 v 1 w Zener (ZD1) | 1 ea |
| S1 | 14 Pin Socket | 1 ea |
| P1 | 5 Pin Plu9 Molex/Amp | 1 ea |
| PC1 | Printed Circuit board | 1 ea |
| 45 | Rechargeable Battery GC 6266 volts 2.6 Amp. Hr. gel/cell (trademark) Globe Battery Division, Johnson Controls, Inc. [5757 No. Green Bay Avenue P.O. Box 591 Milwaulkee, WI 53201] | 1 ea |

INDUSTRIAL APPLICATION

The invention is applicable to industrial and commerical roll-up firedoors situated in public buildngs, hospitals, pharmacies, schools, convalescent homes, or in any other kind of building in which the closing of a firedoor is a hazard to the physical safety of an employee or member of the public. The invention is not limited in its application to a roll-up firedoor, but also to one which is operated in sliding fashion across a doorway. Nor is it limited in application to ingree/egress doors for persons, but also extends to an opening in a wall and through which oral communication between persons occurs. In addition to the invention's applicability to a firedoor control system, the invention also is adaptable to other systems, an example of which being a refrigeration system, wherein a warning system is desired to function when an interruption of voltage to an element in such a system occurs.

Various modifications and changes may be made in the subject matter of the invention, without departing from the scope and spirit thereof, the invention being limited in scope of protection and spirit to the extent only as set out in the following claims.

We claim:

1. A warning system, having a power supply, for generating a warning signal in response to either of two events, detection of smoke by a smoke detector or failure of external power supply to the system, comprising control means connected to an element to which power is supplied and being responsive to such element when power is not supplied thereto for generating a first control signal, a first timer means connected to said element and being responsive thereto for generating a second control signal at the end of a first delay interval, a second timer means connected to said first timer means and being responsive to said second control signal for generating a series of reoccurring control pulses, and signal means connected to said second timer means and being responsive to said control pulses for generating a series of warning signals.

2. The system of claim 1 wherein said element is responsive to the first event and comprises a smoke detector.

3. The system of claim 1 wherein said element is responsive to the second event and comprises a voltage loss detector.

4. The system of claim 2 or claim 3 including therein a firedoor control system having the smoke detector and a time-delay release mechanism responsive to the smoke detector as part of said firedoor control system, the loss of voltage to the smoke detector warning of the imminent closing of a firedoor operatively connected to said time-delay release mechanism.

5. The system of claim 4 wherein said first timer means includes a first timer circuit and a network comprising a resistor, capacitor and diode for briefly delaying the enabling of said first timer circuit.

6. The system of claim 4 wherein said second timer means includes a second timer circuit, a transistor connected to said second timer circuit and from which such re-occurring control pulse emanate, and a timing control circuit comprising a capacitor and resistors for timing such control pulses to said transistor.

7. The warning system of claim 4 wherein said power supply comprises a rechargeable battery for providing power upon loss of voltage to the element or smoke detector, said battery operatively connected to said control means for generating a first control signal.

8. In a firedoor control system having a smoke detector and a firedoor time-delay release mechanism responsive thereto for delaying the closing of the firedoor following either the detection of smoke or a loss of voltage to the smoke detector, the improvement comprising a warning system, having a power supply, for generating a warning signal in response to either of two events, detection of smoke by the smoke detector or failure of external power supply to the firedoor control system, which warning system comprises:

control means connected to said smoke detector and being responsive thereto for generating a first control signal, a first timer means connected to said smoke detector responsive means and being responsive thereto for generating a second control signal at the end of a first delay interval, a second timer means connected to said first timer means and being responsive to said second control signal for generating a series of reoccurring control pulses, and signal means connected to said second timer means and being responsive to said control pulses for generating a series of warning signals.

9. In claim 8, said signal means comprising audible and visual signaling elements.

10. A system apparatus for warning of a firedoor closing prior to initiation of the closing of the firedoor comprising a firedoor-and-hood assembly having a release means, a time-delay release mechanism operatively connected to said release means, at least one smoke detector operatively connected to said time-delay release mechanism, and an electronic circuitry connected in parallel to said time-delay release mechanism and smoke detector for warning of the closing of the firedoor prior to actuation of said time-delay release mechanism.

11. The warning system of claim 10 wherein said power supply comprises a rechargeable battery for providing power upon loss of voltage to the element or smoke detector, said battery operatively connected to said control means for generating a first control signal.

12. The system apparatus of claim 10 wherein said electronic circuitry comprises:

a warning system, which system comprises:

control means connected to said smoke detector and being responsive thereto for generating a first control signal, a first timer means connected to said smoke detector responsive means and responsive thereto for generating a second control signal at the end of a first delay interval, a second timer means connected to said first timer means and responsive to said second control signal for generating a series of re-occurring control pulses, and signal means connected to said second timer means and being responsive to said control pulses for generating a series of warning signals.

13. The system apparatus of claim 12 wherein said signal means comprises audible and visual signaling elements.

14. In claim 1, said control means for generating a first control signal comprising first and second transistors having respective bases, emitters and collectors, the base of the second-transistor connected to the collector of the first transistor, the emitter of the second transistor connected to said first timer means.

15. The system of claim 1 or claim 2 or claim 8 or claim 9 or claim 12 or claim 13 wherein said first timer means includes a first timer circuit and a network comprising a resistor, capacitor and diode for briefly delaying the enabling of said first timer circuit.

16. The system of claim 1 or claim 2 or claim 8 or claim 9 or claim 12 of claim 13 wherein said second timer means includes a second timer circuit, a transistor connected to said second timer circuit and from which such re-occurring control pulses emanate, and a timing control circuit comprising a capacitor and resistors for timing such control pulses to said transistor.

17. The warning system of claim 1 or claim 2 or claim 8 or claim 9 or claim 12 claim 13 or claim 14 wherein said power supply comprises a rechargeable battery for providing power upon loss of voltage to the element or smoke detector, said battery operatively connected to said control means for generating a first control signal.

18. The warning system of claim 17 wherein said control means includes a resistor for regulating voltage and a diode, the diode being connected to the positive terminal of said battery.

19. The warning system of claim 17 including a means for testing said battery.

20. The warning system of claim 18 including a means for testing said battery.

* * * * *